United States Patent [19]

Sando et al.

[11] 4,263,008

[45] Apr. 21, 1981

[54] METHOD AND APPARATUS FOR CONTINUOUSLY CARRYING OUT WEIGHT REDUCTION AND MERCERIZATION OF CLOTH MATERIAL

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 952,403

[22] Filed: Oct. 18, 1978

[30] Foreign Application Priority Data

Oct. 31, 1977 [JP] Japan ..... 52-130568

[51] Int. Cl.[3] ..... D06M 9/00

[52] U.S. Cl. ..... 8/115.7; 8/116 R; 8/125; 68/22 R

[58] Field of Search ..... 8/125, 116 R, 115.7

[56] References Cited

U.S. PATENT DOCUMENTS

| | | | |
|---|---|---|---|
| 3,560,139 | 2/1971 | Suminokura et al. | 8/125 |
| 3,644,137 | 2/1972 | Fox et al. | 8/147 |
| 3,960,484 | 6/1976 | Leimbacher et al. | 8/125 |
| 3,979,177 | 9/1976 | Selling et al. | 8/125 |
| 4,022,574 | 5/1977 | Ichihara | 8/125 |
| 4,095,944 | 6/1978 | Duckworth | 8/115.7 |

FOREIGN PATENT DOCUMENTS

| | | |
|---|---|---|
| 2157257 | 5/1973 | Fed. Rep. of Germany . |
| 2544494 | 4/1977 | Fed. Rep. of Germany . |

OTHER PUBLICATIONS

Wingate, Fairchild's Dictionary of Textiles, 1975, pp. 364, 365 & 540.

*Primary Examiner*—A. Lionel Clingman

[57] ABSTRACT

A method for continuous weight reduction and mercerization of a cloth material. The cloth material which is impregnated with a caustic liquid is first treated with humid heat in a no tension condition to effect reduction in weight and then the cloth material is brought into frictional contact with friction rolls under the same humid heat to mercerize the cloth material in a continuous manner. The method is carried out within a high pressure steamer drum body in which the high humid heat is maintained. A group of rolls are arranged within the fore half portion of the high pressure steamer drum body to convey the cloth material in the no tension condition. In the hind half of the drum body, there are arranged a group of guide rolls to further convey the cloth material with a predetermined degree of tension applied thereto. Some of the group of guide rolls are driven at a variable speed to bring the cloth material into frictional content with them.

1 Claim, 1 Drawing Figure

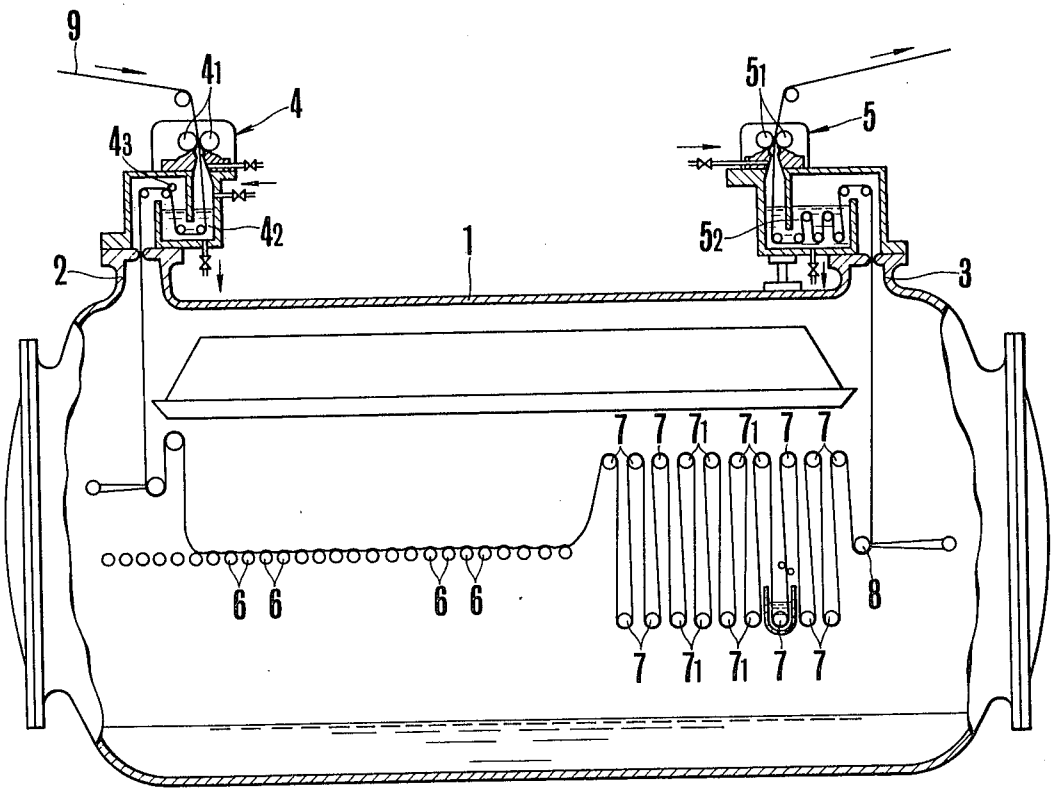
1
2
3
4
$4_1$
$4_2$
$4_3$
5
$5_1$
$5_2$
6
7
$7_1$
8
9

METHOD AND APPARATUS FOR CONTINUOUSLY CARRYING OUT WEIGHT REDUCTION AND MERCERIZATION OF CLOTH MATERIAL

BACKGROUND OF THE INVENTION

1. Field of the Invention

This invention relates to a method and an apparatus for continuously carring out weight reducing and mercerizing processes for a cloth material by passing the cloth material through a single unit of a high pressure steamer.

2. Description of the Prior Art

A weight reducing process for a cloth material which consists 100 percent of a synthetic fiber or contains a synthetic fiber to a certain degree is well known. However, the conventional weight reducing process is inefficient because it is carried out under a humid heat of 100° C. or below and thus takes a long period of time (about 10 hours for example). Further, in the case of a weight reducing process by a conventional hanging method, it not only takes a long period of time but also results in uneven quality of products.

A mercerization process for a cotton cloth material or cotton yarn is also known. However, the conventional mercerization process has been carried out separately from other processes and thus has required a great amount of heat energy, much labor, etc. This has resulted in a high cost of the manufacture of textile products obtained through the mercerization process.

The present invention is directed to the solution of the problems of these conventional processes.

SUMMARY OF THE INVENTION

It is therefore an object of this invention to provide a continuous treating method for a cloth material to be subjected to weight reducing and mercerizing processes which are carried out by supplying the cloth material into a high pressure steamer and by simultaneously effecting the weight reduction and the mercerization through a hygro-thermic treatment of the cloth material within the high pressure steamer. In accordance with this invention, both the weight reducing and mercerization processes can be carried out within the same steamer, so that, compared with the conventional method of separately carrying out a weight reducing process and a mercerizing process, these processes can be very efficiently carried out with heat energy and cost of labor and facilities reduced by half.

It is another object of this invention to provide an apparatus for carrying out the above stated method of the present invention.

The foregoing and other objects and features of the invention will be apparent from the following description and claims taken in connection with the accompanying drawing.

BRIEF DESCRIPTION OF THE DRAWING

The accompanying drawing is a sectional view showing an apparatus as embodiment of the present invention.

DETAILED DESCRIPTION OF PREFERRED EMBODIMENT

Referring to the accompanying drawing, a reference numeral 1 indicates a high pressure steamer drum body adapted for treating a cloth material under a high pressure humid heat condition. The steamer drum body is provided with a cloth material inlet port 2 and a cloth material outlet port 3. At the inlet and outlet ports 2 and 3, there are provided an entrance seal mechanism 4 and an exit seal mechanism 5. These seal mechanisms are provided for the purpose of keeping a high humid heat within the high pressure steamer drum body 1 while the cloth material is allowed to be guided into and out of the drum body 1. The seal mechanism 4 which is provided on the entrance side comprises a pair of seal rubber rolls $4_1$ which are in pressed contact with each other; a liquid seal tank $4_2$ which is disposed closer to the inlet port 2 than the seal rubber rolls; and wringer rolls $4_3$. The other seal mechanism 5 which is provided on the exit side of the drum body 1 comprises a pair of seal rubber rolls $5_1$ which are in pressed contact with each other; and a slow cooling tank $5_2$ which is disposed closer to the outlet port 3 than the seal rubber rolls $5_1$.

A group of rolls 6 are arranged in a row within the fore half portion of the steamer drum body 1, each being provided with a driving mechanism to convey the cloth material in a no tension condition and are rotated at a predetermined speed. In the hind half portion of the steamer drum body 1, there are provided groups 7 and $7_1$ of guide rolls which are arranged in upper and lower stages; and each of them is rotated by a suitable driving mechanism which is not shown in the drawing to cause the cloth material to travel up and down in a zigzag manner thereon. Among these guide roll groups 7 and $7_1$, some of the guide rolls, for example guide rolls $7_1$, are arranged to be rotatable at a higher circumferential speed than other guide rolls 7. A reference numeral 8 indicates a tension adjustment roll; and 9 indicates the cloth material which is to be subjected to the weight reducing and mercerizing processes and which is, for example, a mixed cloth material consisting of 50% polyester and 50% cotton.

The embodiment of the invention described in the foregoing operates as follows: Before operation, a caustic liquid of concentration about 10% is put in the liquid seal tank $4_2$ of the entrance seal mechanism 4; and the slow cooling tank $5_2$ of the exit seal mechanism 5 is filled with a cooling water. Then, the inside of the steamer drum body 1 is arranged to have a high humid heat of 120° C. to 150° C. While keeping the inside of the drum body 1 in this humid heat condition, the cloth material 9 is supplied into the drum body 1 by passing it through the inside of the liquid seal tank $4_2$ of the entrance seal mechanism. This causes the cloth material to be impregnated with the caustic liquid. The degree of impregnation is adjusted to a preset degree by the wringer rolls $4_3$ before the cloth material enters the inside of drum body. Inside the drum body 1, the cloth material which has been thus impregnated with the caustic liquid is conveyed by the horizontal array of rolls 6 in a no tension condition while thus being subjected to the high humid heat for weight reduction. During this process, there takes place a setting effect in the cloth material. The cloth material which has undergone this weight reducing process is then caused to move up and down in a zigzag manner by the guide roll groups 7 and $7_1$ with a suitable degree of tension applied thereto while it is continuously subjected to the steaming treatment. Then, since some of the guide rolls, i.e. the guide rolls $7_1$ for example, are rotating faster than other guide rolls, friction of the cloth material takes place as it comes into contact with the guide rolls $7_1$.

Then, in conjunction with the steaming treatment and the caustic liquid with which the cloth material is impregnated, this friction comes to impart a silk-like luster to the surface of the cloth material to effect the desired mercerization.

The mercerized cloth material is gradually cooled through the inside of the slow cooling tank $5_2$ and then is guided to the outside of the steamer through the seal rubber rolls $5_1$.

The embodiment of the invention is as described in the foregoing. In accordance with the invention, a cloth material impregnated with a caustic liquid is supplied to the inside of the high pressure drum body 1. Within the fore half portion of the inside of the steamer drum body 1, a weight reducing process for the cloth material 9 is carried out through a hygro-thermic treatment which is effected while the cloth material 9 is conveyed in a no tension state. Immediately after the weight reducing process, the cloth material is further conveyed by the group of guide rolls 7 and $7_1$ with a suitable degree of tension being applied thereto. During this conveying operation, the cloth material is brought into frictional contact with some of the guide rolls, i.e. guide rolls $7_1$ for example, which rotate at a higher speed than other guide rolls. The friction between the cloth material and the guide rolls imparts a silk-like luster to the surface of the cloth material, so that the mercerization process can be continuously carried out. Since, in accordance with this invention, a weight reducing process and a mercerization process can be continuously carried out through the same high pressure steamer, the required facilities for these processes can be simplified as compared with the conventional facilities which are adapted for carrying out these two processes separately from each other. In addition to that, heat energy and water resources can be economized. Further, in accordance with this invention, since the use of a high pressure steamer permits the continuous weight reducing and mercerizing processes at a rate of only several minutes per unit length of the cloth material. This high processing efficiency then brings about reduction in the manufacturing cost.

What is claimed is:

1. A method of continuously carrying out successive weight reducing and mercerizing treatments on a cloth material comprised of a mixture of cotton and man-made fibers comprising the steps of feeding the cloth material into and through a high pressure steamer from an inlet to an outlet, impregnating the cloth material with a caustic alkali solution as it enters the steamer at the inlet, applying humid heat at a temperature above 100° C. to the cloth material as it moves through the steamer, after impregnating the cloth material transferring the cloth material in a tension-free condition within the steamer from adjacent the inlet to a location intermediate the inlet and outlet and spaced from the outlet and thereby reducing the weight of the cloth material, immediately after completing the weight reducing step moving the cloth under tension over a zig-zag arrangement of rolls member and arranging at least one friction roll member rotating at a higher speed than the other roll members in the steamer and frictionally contacting the cloth material with the friction roll member and thereby mercerizing the cloth material and improving its luster, and after the completion of the mercerizing step moving the cloth material to the outlet.

* * * * *